US005743602A

United States Patent [19]

Maddux et al.

[11] Patent Number: 5,743,602

[45] Date of Patent: Apr. 28, 1998

[54] COLD PLATE AND SEAL

[75] Inventors: Larry D. Maddux, Westminster; Jeff Nicholson, Huntington Beach; Fred Windisch, Lakewood, all of Calif.

[73] Assignee: Cambro Manufacturing Company, Huntington Beach, Calif.

[21] Appl. No.: 695,236

[22] Filed: Aug. 8, 1996

[51] Int. Cl.[6] ..... A47B 96/18; A47F 9/00

[52] U.S. Cl. ..... 312/140.1; 312/236; 312/228; 312/229; 62/400; 62/390; 222/146.6

[58] Field of Search ..... 312/140.1, 140.2, 312/236, 228, 229, 249.8; 62/344, 400, 390, 393, 396, 398, 460, 461, 464; 222/146.6, 608

[56] References Cited

U.S. PATENT DOCUMENTS

| | | | |
|---|---|---|---|
| 1,840,033 | 1/1932 | Hampton | 312/140.2 |
| 2,083,477 | 6/1937 | Simard | 312/140.1 X |
| 3,983,583 | 10/1976 | Herman et al. | 312/140.2 X |
| 4,651,638 | 3/1987 | Bull et al. | 62/400 X |
| 4,678,104 | 7/1987 | Prichett | 62/344 X |
| 4,958,505 | 9/1990 | Swanson | 62/400 X |
| 5,226,296 | 7/1993 | Kolvites | 222/146.6 X |
| 5,251,790 | 10/1993 | Cohn et al. | 312/140.1 X |
| 5,350,086 | 9/1994 | Martin et al. | 62/400 X |
| 5,419,393 | 5/1995 | Guy, III | 62/393 X |
| 5,484,015 | 1/1996 | Kyees . | |

*Primary Examiner*—Peter M. Cuomo
*Assistant Examiner*—Hanh V. Tran
*Attorney, Agent, or Firm*—George F. Bethel; Patience K. Bethel

[57] ABSTRACT

A portable bar having a sink disposed therein having a base member having a central opening with a trough disposed peripherally around the opening. A cold plate is sealed against a side wall of the trough within the sink opening. The cold plate is formed of a heat transfer material such as a metal formed into at least one major surface and has a plurality of internal channels for circulation of fluid to be cooled. A peripheral flange surrounding the cold plate has a unique inwardly angled leading edge and an outwardly angled trailing edge for sealing to the trough of the sink.

20 Claims, 4 Drawing Sheets

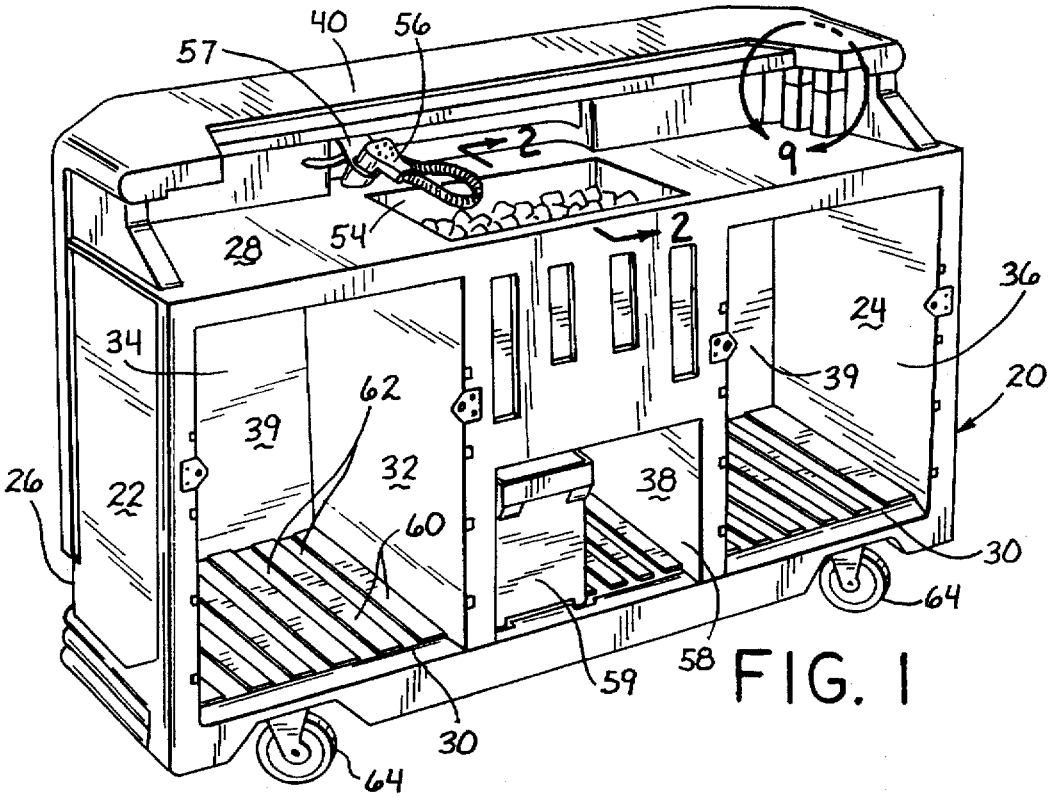
FIG. 1
FIG. 2
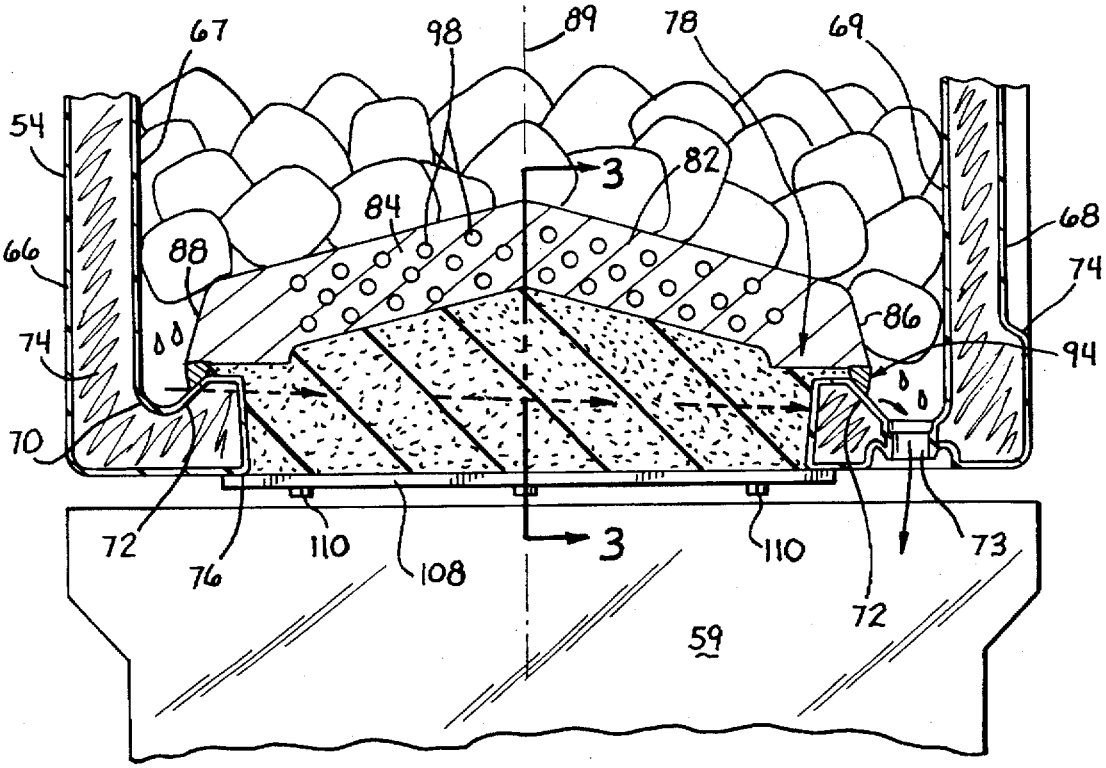

FIG. 7
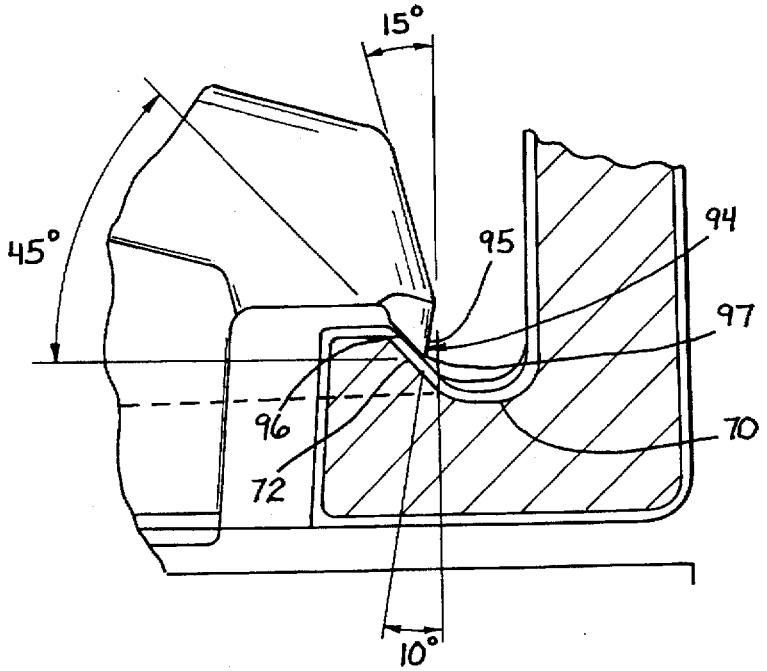
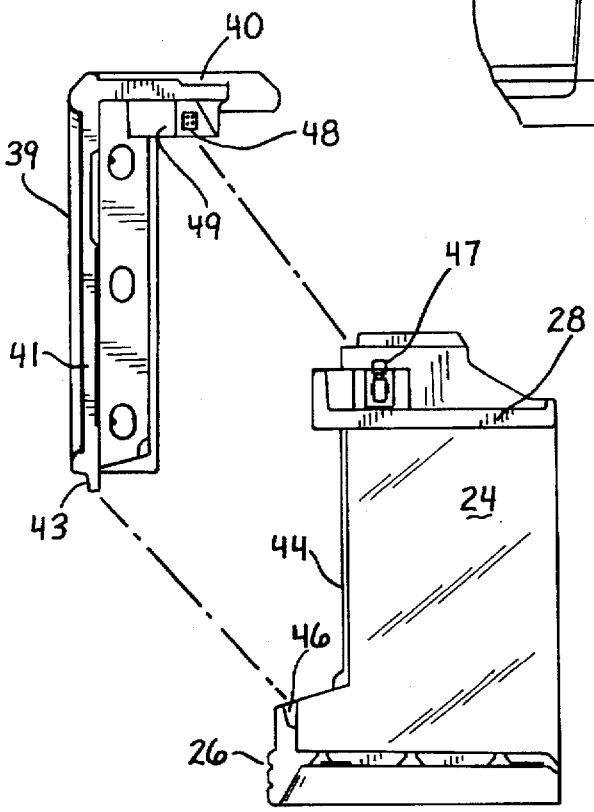
FIG. 8
FIG. 9
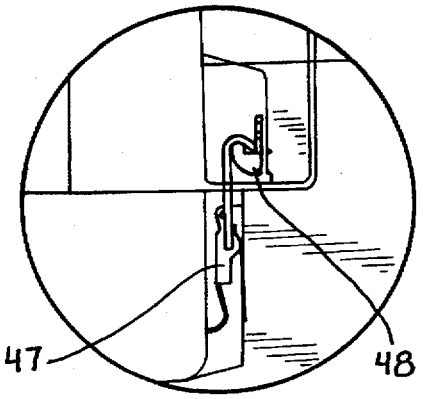

COLD PLATE AND SEAL

FIELD OF THE INVENTION

This invention relates to the field of portable bars and particularly to a portable bar having a novel cold plate which embodies a unique seal.

BACKGROUND OF THE INVENTION

Portable bars are frequently used in hotels for receptions and the like to provide soda mixing and ice wherever needed.

Generally portable bars have a generally rectangular shaped box provided with locking casters. The bar is divided into compartments to hold soda syrups, soda pumps, pre-mix and post-mix solutions, carbon dioxide tanks, fresh water tanks, hoses, containers, tanks and other equipment.

The top of the bar has a sink which is formed to hold a cold plate through which the soda, pre-mix, post-mix or water lines or tubing pass for cooling. The cold plate is made of a heat conductive material such as a metal. The cold plate is commonly several inches thick to accommodate the soda and other lines. It is generally sized to cover the base of the sink.

In operation, the sink is filled with ice so that the ice contacts the cold plate. As the ice melts, it cools the cold plate which in turn chills the soda, pre-mix, post-mix, or water lines or tubing which pass through the cold plate.

As the ice melts, the water collects around the cold plate and is removed by means of a drain in the sink. Since the water surrounds the cold plate, it is possible for bacteria, mold, fungus or other microorganisms to grow around the crevices between the cold plate and the surfaces of the sink. As a consequence, it is necessary to remove the cold plate from the sink at regular intervals to sanitize and clean the sink and the cold plate to avoid bacterial and fungal growth.

Removal of the cold plate from the sink for cleaning can be difficult and inconvenient. The cold plate is quite heavy making it difficult to handle. It is usually bolted to the sink. Moreover, the lines or tubing which are attached must be disconnected and reconnected during removal.

It is an object of the invention to provide a cold plate having a unique edge having an inwardly angled leading or forward edge and an outwardly angled trailing or rearward edge which effectively forms a seal with a surface of the sink.

It is a further object of the invention to provide a cold plate having a unique top surface which slopes downwardly on two sides to encourage a constant washing action with the melting of ice placed on the surface.

It is another object of the invention to provide a cold plate incorporating the unique sharpened edge in combination with a sink.

It is final object of the invention to provide a portable bar having a sink in which the cold plate incorporating the unique edge is sealed.

SUMMARY OF THE INVENTION

A portable bar is provided by the invention which incorporates a cold plate disposed within a sink. The cold plate of the invention is formed of a cast metal having a top surface formed by two sides which slope away from a central crown or ridge. The top surface is surrounded by side walls which terminate in an outer peripheral flange or skirt.

The peripheral flange or skirt is formed with a leading or forward edge which slopes inwardly with respect to the side walls and a trailing or rearward edge which slopes outwardly with respect to the side walls to form a reduced or relatively sharp edge or flange. The flange has a generally triangular cross section.

Within the cold plate are disposed a series of tubular channels or passages arranged in curves or coils to form one or more turns. The tubular members carry various liquids through the cold plate for purposes of cooling.

The tubular members and lines enter and leave the cold plate through a manifold formed within a rectangular member which extends from the interior of the cold plate.

The cold plate is received within a central opening in a sink. The sink has a channel member or trough formed around the periphery of its base. The channel member has an inner sloping or slanting wall and is provided with a drain to allow liquids to be drained away.

A flat plate which is larger than the sink opening and has an opening sized to accommodate the rectangular member is placed under the sink opening for bolting to the cold plate. This presses or holds the sharp flange member tightly against the matching sloping or slanting surface of the channel member to form a tight seal.

The space between the plate and the interior surface of the cold plate can be filled with an insulating material such as a foamed insulation.

The sink and cold plate can be attached to a portable bar or be in a permanent setting. The advantage is that the cold plate forms such a tight seal with the sink channel walls that melting ice flows downwardly from the top of the cold plate and drains away without harboring organisms which would require removal and cleaning. In addition, the melting ice forms a constant flow of liquid over the surface of the cold plate to provide a continuous washing action.

The invention will be more readily understood by the description which follows together with the following Figures.

BRIEF DESCRIPTION OF THE DRAWINGS

FIG. 1 shows a perspective view of a portable bar incorporating a cold plate and sink according to the invention, FIG. 2 shows a cross section of the cold plate of the invention taken along the lines 2—2 of FIG. 1.

FIG. 7 shows an enlarged detail of the sharp flange or angularly reduced edge of the cold plate of the invention.

FIG. 8 shows an exploded perspective view of a section of the removable front panel and a main body section of the portable bar shown in FIG. 1.

FIG. 9 shows an enlarged detail of the latch and latch hook shown encircled by circle 9 in FIG. 1.

DETAILED DESCRIPTION OF THE INVENTION

Figure 3:
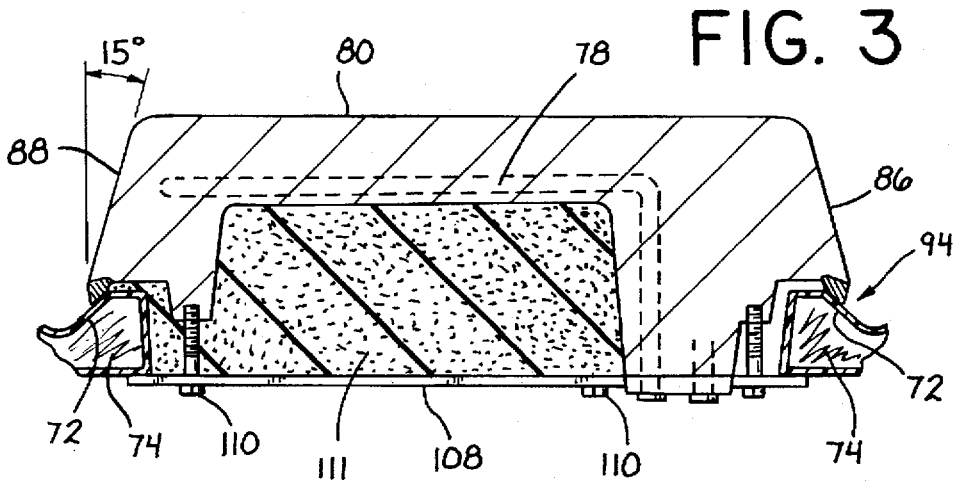
FIG. 3 shows a cross section of the cold plate shown in FIG. 2 taken along the lines 3—3.

Referring now to FIGS. 1 and 8, there can be seen a portable bar 20 having side walls 22 and 24 which are joined at the front to a skirtwall 26, an upper panel or counter 28, and a base panel member 30. An interior wall 32 and an exterior side wall 22 form an open storage compartment 34. A similar open storage compartment 36 is formed by an exterior side wall 24 and an interior wall 38.

A separate, removable front wall panel 39 has an attached raised panel or narrow counter 40 for preparation of drinks. The panel or narrow counter 40 is spaced above and partially overlies upper panel or counter 28. As shown in FIG. 8, front wall 39 contains side grooves 41 and lower tangs or shanks 43. The side grooves 41 slidably receive side flanges 44 on exterior sidewalls 22 and 24 while tangs or shanks 43 slidably interlock with grooves or recesses 46 on skirtwall 26 for installation and removal.

As shown in FIGS. 8 and 9, a latch 47 on each of side walls 22 and 24 of portable bar 20 interlocks with a latch hook 48 on a vertical extension 49 attached to each side of counter 40 of front wall panel 39. In this manner, the front wall 39 is secured to the side walls 22 and 24 of portable bar 20.

There is a particular advantage to removal of the front wall panel 39 in order to permit access to all parts of the portable bar 20. By releasing the latches 47 and pulling upwardly, the front wall panel 39 can be completely removed from the portable bar 20.

Within the upper panel or counter 28 is a sink 54. Disposed above the sink 54 is a soda gun 56 held in a support bracket 57. Below the sink is a storage compartment 58 which contains a waste water bin 59.

The base panel member 30 is provided with a plurality of integrally formed, spaced apart, raised long narrow members or ribs 60. Between the members or ribs 60 are spaces 62, lower than the members 60, which accumulate any moisture from items stored on the base member 30.

Casters 64 which can be provided with brakes provide ease and convenience in moving the portable bar 20 to a desired location.

The sink 54 is generally rectangular in cross section being formed by four side walls. Other configurations can be used including among others, circular, oval, square and the like without departing from the invention.

As shown in FIG. 2, the side walls 66 and 68 are double walled so that the outer walls 66 and 68 have an L shape in cross section at the base while the inner walls 67 and 69 have a reverse open J shape in cross section to form an inner peripheral channel or trough 70. The trough 70 has a portion 72 which extends upwardly at an angle of about 45°±10°. Within the trough or channel 70 is an opening or drain 73, preferably located at a low point, which communicates with the waste water bin 59.

The spaces between double sided walls 66, 67 and 68, 69 of the sink 54 are preferably filled with foam insulation 74. The sink 54 with the outer side walls 66 and 68 and inner side walls 67 and 69 define an opening 76 therein. Secured within the opening 76 of the sink 54 is a cold plate 78.

The top of the cold plate 78 has a crown or ridge 80 with sloping surfaces 82 and 84 extending from the crown or ridge 80. The sloping surfaces 82 and 84 each extend into sloping members or skirts 86 and 88 respectively. Sloping sidewalls 90 and 92 are separated by sloping surfaces 82 and 84, and skirt walls 86 and 88.

The cold plate 78 has a central axis 89 shown in FIG. 2. The sloping surfaces of the skirt walls 86 and 88 and sidewalls 90 and 92 slope outwardly from the central axis 89 at an angle of at least about 15°.

As used herein and in the appended claims, the term "the vertical" is meant to describe a vertical line normal to a base surface, or plane parallel to the base.

As seen particularly in FIGS. 2, 3, and 7 there is a peripheral beveled border flange 94 extending from and attached to a bottom surface of the cold plate 78. The flange 94 has a sharpened, or reduced angular edge adapted to engage a plastic surface of the sink 54. Preferably, the peripheral border flange 94 has a leading edge 95 which slopes inwardly at about 10°±5° toward the central axis 89.

The adjacent facing or trailing edge 96 is beveled or sloped outwardly, preferably at an angle of about 45°±10° from the central axis 89 for sealing contact with surface 72 of inner sidewalls 67 and 69 of sink 54. The leading edge 95 and the trailing edge 96 forms the sharpened or reduced edge flange 94 which has a substantially triangular cross section.

The sharpened or reduced edge flange 94 with the two angular edges 95 and 96 can be formed as any angular surfaces terminating in an apex 97. The apex 97 can be slightly formed, or highly reduced and sharpened depending on the plastic material it interfaces with. The apex 97 can also be rounded, beaded or ridged having multiple ridges along its apex for seating against the plastic surface it interfaces with.

Preferably, the major material of the cold plate 78 is formed of aluminum with the angular or triangular portion with walls 95 and 96 being formed of aluminum which is machined to the desired dimensions.

In some instances where the sharpened edge may be subject to abuse, a hardened metal such as stainless steel, tungsten carbide, tool steel or the like can be brazed, welded, connected to or formed with the major material portion of the cold plate 78.

As seen in FIGS. 3–6, the cold plate 78 has coils or loops of tubing 98 disposed within the cold plate 78 to form passages or channels for flow of fluid. Preferably, the tubing 98 is cast within the cold plate 78 so that it is in heat-transfer relationship. A box-like manifold 100 projects from an inner surface 101 of cold plate 78. The manifold 100 communicates with the passages or channels formed by tubing 98 within cold plate 78. A plurality of openings 102 within manifold 100 have individual connectors 104 for connection to entering and exiting soda, water or syrup lines.

The inner surface 101 of the cold plate 78 is also provided with a plurality of bored, internally threaded supports, posts, or pylons 106. As seen in FIGS. 2 and 3, a flat plate 108 which is larger than the opening 76 of sink 54 and having an opening sized to accommodate the manifold 100 is secured to the outer side walls 66 and 68 of the sink 54 by means of threaded bolts 110 which are received in pylons 106. The bolts 110 are tightened sufficiently to press or tightly hold the beveled edge 96 of cold plate 78 and portion 72 of trough 70 to provide a tight seal therebetween.

Preferably, insulation 111 is foamed into the space between the cold plate 78 and the flat plate 108. This increases the heat transfer efficiency of the cold plate 78.

Figure 6:
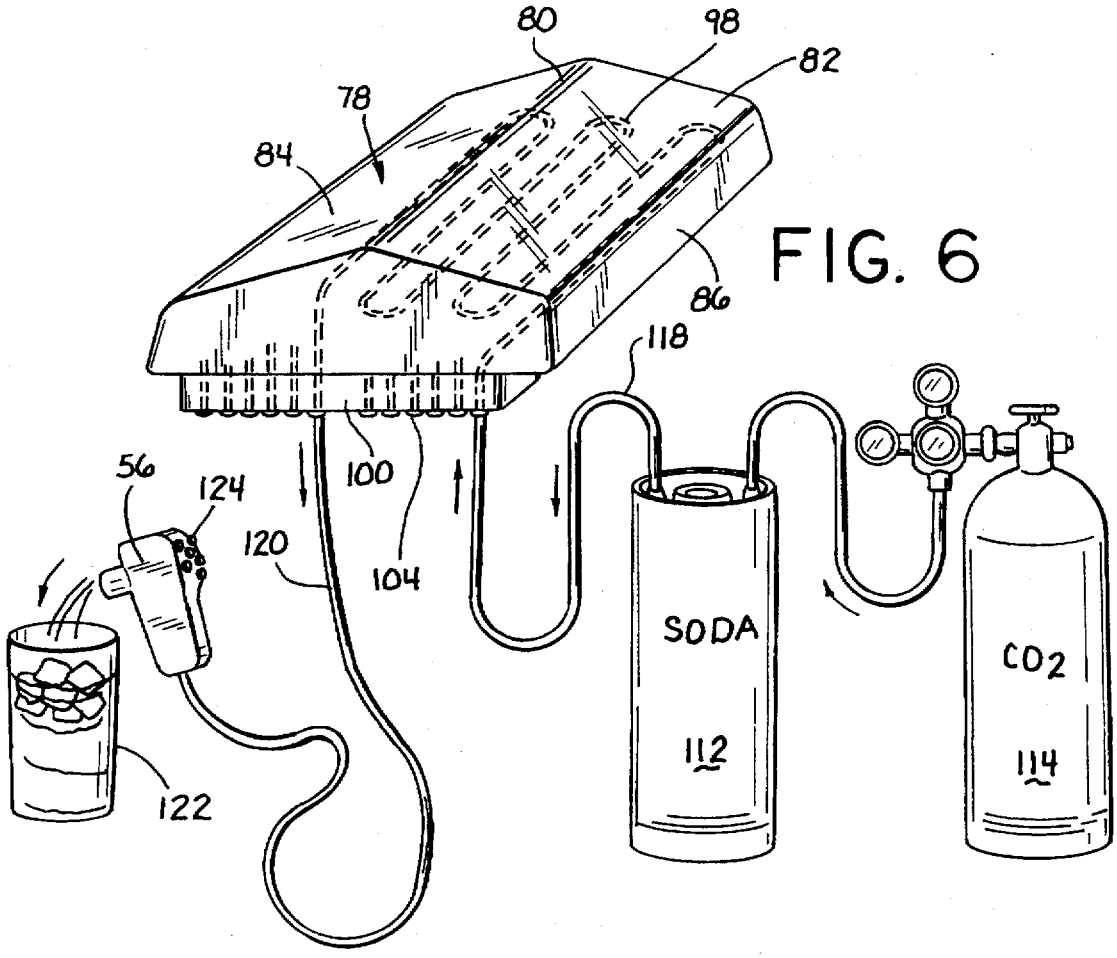
FIG. 6 shows the entry and exit paths of the liquids from the premix and carbonated containers through the cold plate of the invention.
Figure 4:
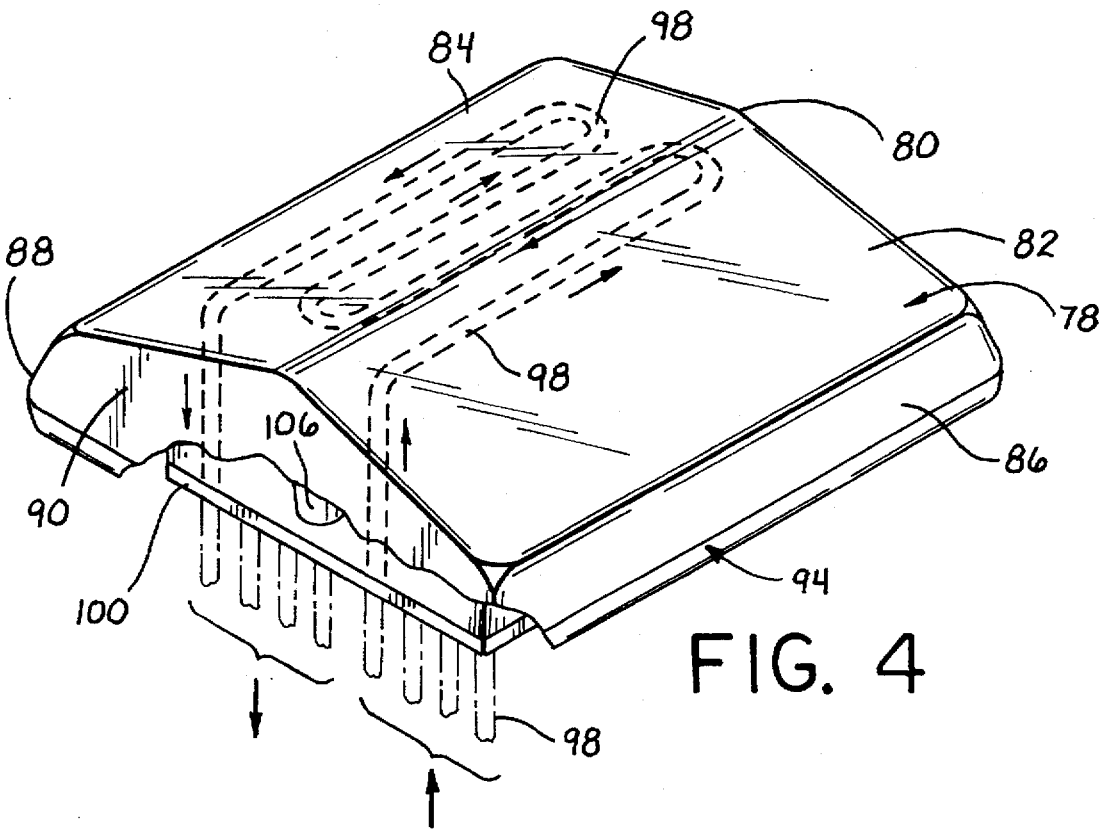
FIG. 4 shows a partially broken away perspective view of the top of the cold plate of the invention with the tubing or channels which are formed therein.
Figure 5:
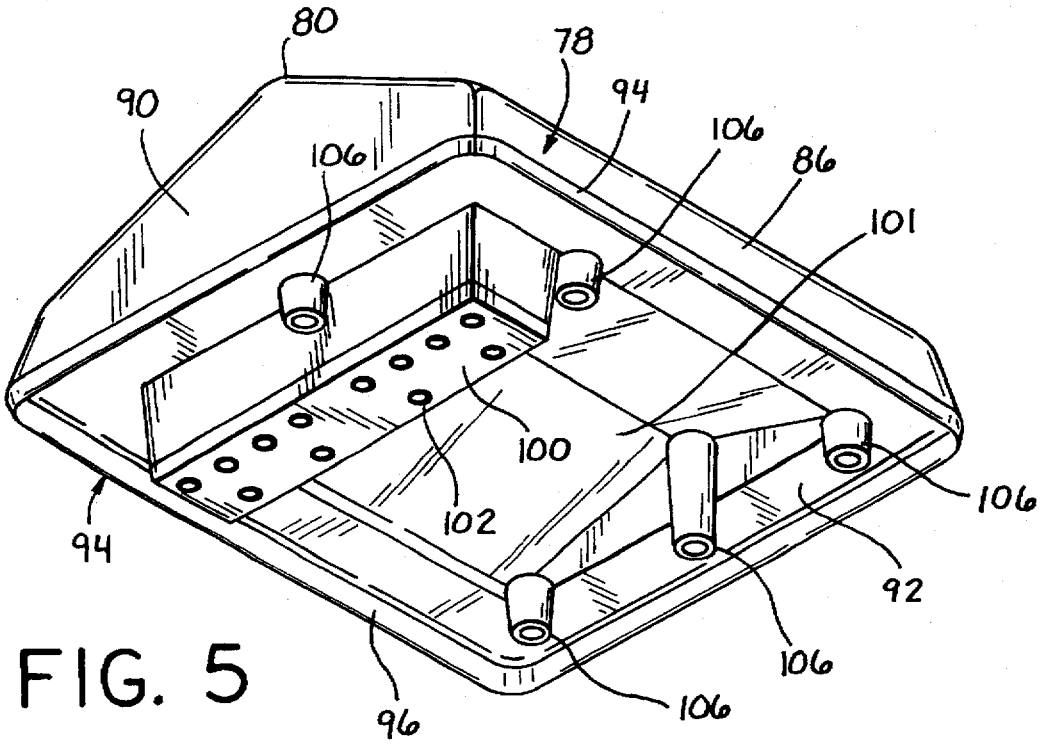
FIG. 5 shows a perspective view of the underside of the cold plate of the invention including the manifold.

In operation, ice is placed in the sink 54 in contact with the cold plate 78 in the manner shown in FIG. 2. As shown in FIG. 6, pre-mix soda 112 and carbon dioxide are introduced into the cold plate 78 through tubing 118 and connectors 104 in manifold 100. The cold plate 78 which is cold from surface contact with the ice cools the soda and carbon dioxide which passes through the tubing 98 within cold plate 78. The cooled mixture exits the cold plate 78 through connectors 104 and exit tubing 120 to soda gun 56 for use in preparing drinks.

As the ice melts, water collects within the trough or channel 70 surrounding the cold plate 78 and drains into the waste water bin 59 through opening 73 in channel 70. Because of the tight seal between the beveled edge 96 of cold plate 78 and portion 72 of trough 70 water does not collect therein so that removal of the cold plate and cleaning to preserve sanitary conditions is not required.

Preferably the cold plate 70 is made of cast aluminum although other materials such as other metals or plastics can be used. The coiled tubing 98 is preferably made of stainless steel but other materials can be used.

Also, while the cold plate 70 is shown with 6 separate tubing or coiled circuits 98, the invention is not limited to the number of circuits.

The tubing 104 entering the manifold 100 and the tubing 120 exiting the manifold 100 through connectors 104 represent a single circuit for each different liquid to be cooled. The tubing 120 carries the cooled liquid to the soda gun 56. Each separate circuit connected to the soda gun 56 releases cooled liquid in response to pressing of a separate button 124 on soda gun 56. Preferably, each separate circuit is enclosed within a flexible hose attached to the soda gun 56.

Preferably, the portable bar is formed of a tough outer plastic shell having a double wall with a space between the walls which is filled interiorly with a rigid foam in the manner shown in the cross section of the sink 54 shown in FIG. 2. This combination provides exterior and interior structural strength and toughness as well as light weight. In addition, the plastic allows for ease in cleaning as well as to provide a resilient surface to avoid chipping of glasses and dishes interiorly and marking of walls exteriorly.

The most preferred plastic material is a polyethylene material which is preferably rotationally molded and then subsequently filled with a polyurethane foam. The polyurethane foam also provides an insulating effect.

Although less preferred, other methods of producing the bar can be used such as, for example, using blow molding or injection molding. Similarly, while the preferred plastic is a dense polyethylene plastic other plastics can be used such as, for example, polycarbonate, polysulfone, polypropylene, ABS, and SAN among others. The exact plastic used should not limit the invention. Many plastics can be substituted for those mentioned which will be obvious to those skilled in the art.

If desired, the plastic outer shell can be replaced with a thin metal such as, for example, aluminum.

Similarly, in place of the rigid polyurethane there can be substituted other foams or other materials to fill the exterior shell.

Also, while the shape of the sink is shown to be generally rectangular in cross section, other configurations including round, oval, and polygonal can be used.

Various modifications of the invention are contemplated which will be obvious to those skilled in the art and can be resorted to without departing from the spirit and scope of the invention as defined in the following appended claims.

We claim:

1. A cold plate for cooling fluids flowing therethrough comprising:

at least one major first surface for contact with a cold material;

said at least one major first surface having a bottom peripheral edge, a plurality of channels disposed within said cold plate in heat transfer relationship with said at least one major first surface;

means for connecting to said channels for flow of fluids therethrough; and, a peripheral flange attached to said bottom peripheral edge of said at least one major surface, said flange having at least one reduced edge in sealing contact with at least one second sloping surface; wherein said peripheral flange is adapted to space said major first surface from said at least one second sloping surface.

2. A cold plate according to claim 1 wherein:

said peripheral flange has an angularly reduced edge.

3. A cold plate according to claim 2 wherein:

said cold plate has a central axis; and, said peripheral flange has a trailing edge which slopes outwardly from said central axis and a leading edge which slopes inwardly toward said central axis.

4. A cold plate according to claim 3 further comprising:

sidewalls formed between said at least one major first surface and said bottom peripheral edge.

5. A cold plate according to claim 4 wherein:

said at least one major first surface comprises a ridge having at least one surface sloping away from said ridge.

6. A cold plate according to claim 3 wherein:

said leading edge and said trailing edge meet to form a sharpened angular edge having a substantially triangular cross section.

7. A cold plate according to claim 3 wherein:

said cold plate is made of a metal.

8. A cold plate according to claim 5 wherein said at least one major first surface comprises:

two surfaces sloping away from said ridge;

and wherein said reduced edge of said flange is formed of a harder metal than the remainder of the cold plate.

9. A cold plate according to claim 1 wherein:

said cold plate is formed of a metal; and, said means for connecting to said channels for flow of fluids therethrough comprises a manifold.

10. The combination of a sink and a cold plate for cooling fluids flowing therethrough comprising:

a sink comprising:

at least one generally upright side wall;

a base member attached to said at least one generally upright side wall;

an opening within said base member;

a trough within said base member disposed peripherally around said opening, said trough having at least one sloping surface for sealing;

a cold plate disposed within said sink comprising:

at least one major first surface for contact with a cold material;

said at least one major first surface having a bottom peripheral edge, a plurality of channels disposed within said cold plate in heat transfer relationship with said at least one major first surface;

means for connecting to said channels for flow of fluids therethrough;

a peripheral flange secured to said bottom peripheral edge of said at least one major first surface in sealing contact with said at least one sloping surface for sealing of said trough wherein said peripheral flange is adapted to space said major first surface from said at least one sloping surface; and, means for pressing said peripheral flange into sealing contact with said at least one sloping surface for sealing of said trough.

11. The combination according to claim 10 further comprising:

a drain disposed within said trough.

12. The combination according to claim 10 wherein:

said peripheral flange has a reduced, angular edge for engaging a plastic surface.

13. The combination according to claim 12 wherein:

said cold plate has a central axis;

said peripheral flange has a trailing edge which slopes outwardly from said central axis; and, said peripheral flange has a leading edge which slopes inwardly toward said central axis, both forming said reduced angular edge.

14. The combination according to claim 10 further comprising:

sidewalls formed between said at least one major surface and said bottom edge region.

15. The combination according to claim 14 wherein:

said at least one major surface comprises a ridge having at least one surface sloping away from said ridge.

16. A portable bar comprising:

a top member;

a base member;

at least two sidewalls disposed between said base member and said top member;

a sink disposed within said portable bar;

said sink comprising:

at least one generally upright sidewall;

a base member attached to said at least one generally upright side wall;

an opening within said base member;

a trough within said base member disposed peripherally around said opening, said trough having at least one sloping surface;

a cold plate disposed within said opening of said sink;

said cold plate comprising:

at least one major surface for contact with a cold material and having a bottom peripheral edge;

a plurality of channels disposed within said cold plate in heat transfer relationship with said at least one major surface;

means for connecting to said channels for flow of fluids therethrough;

a peripheral flange extending from said bottom peripheral edge and having a sloping surface adapted for sealing contact with said at least one sloping surface of said trough; wherein said peripheral flange is adapted to space said one major surface from said at least one sloping surface and, means for pressing said peripheral flange into sealing contact with said at least one sloping surface of said trough.

17. The portable bar according to claim 16 further comprising:

a drain disposed within said trough.

18. The portable bar according to claim 17 wherein:

at least one of said sidewalls of said portable bar is removable; and, wherein:

said at least one sloping surface of said trough matches said sloping surface of said peripheral flange.

19. The portable bar according to claim 16 wherein:

said cold plate has a central axis;

said means for pressing said peripheral flange in sealing relationship against said at least one sloping surface of said trough comprises:

a base plate underlying said sink and secured to said cold plate and said sink;

said peripheral flange has a leading edge which slopes inwardly toward said central axis; and, said peripheral flange has a trailing edge which slopes outwardly from said central axis.

20. The portable bar according to claim 16 wherein said cold plate further comprises:

sidewalls attached to said cold plate; and, said at least major surface comprises a ridge having at least one surface sloping away from said ridge.

* * * * *